US006322072B1

(12) United States Patent
Mair et al.

(10) Patent No.: US 6,322,072 B1
(45) Date of Patent: Nov. 27, 2001

(54) GAME SPINNER

(76) Inventors: David Mair, 42 Lawrence Rd., Randolph, NJ (US) 07869; James Winslow, 16 Maple Ter., Maplewood, NJ (US) 07040

( * ) Notice: Subject to any disclaimer, the term of this patent is extended or adjusted under 35 U.S.C. 154(b) by 0 days.

(21) Appl. No.: 09/430,098

(22) Filed: Oct. 29, 1999

(51) Int. Cl.[7] ..... A63F 5/04
(52) U.S. Cl. ..... 273/141 R
(58) Field of Search ..... 273/141 R, 141 A

(56) References Cited

U.S. PATENT DOCUMENTS 424,132 * 3/1890 Regensteiner et al. ..... 273/141 R
2,018,041 * 10/1935 Tomasevich ..... 273/141 R
4,355,481 10/1982 Joslyn .
5,332,227 * 7/1994 Passero ..... 273/141 R

FOREIGN PATENT DOCUMENTS 927674 5/1963 (GB) .
9182879 7/1997 (JP) .

* cited by examiner

*Primary Examiner*—Benjamin H. Layno
(74) *Attorney, Agent, or Firm*—Kirschstein, et al.

(57) ABSTRACT

A game spinner rotates an indicator to a selected random position on a dial by compressing a spring and releasing its stored energy. A clutch is engaged during the energy release to transmit a rotary force to the indicator.

17 Claims, 3 Drawing Sheets

FIG. 1
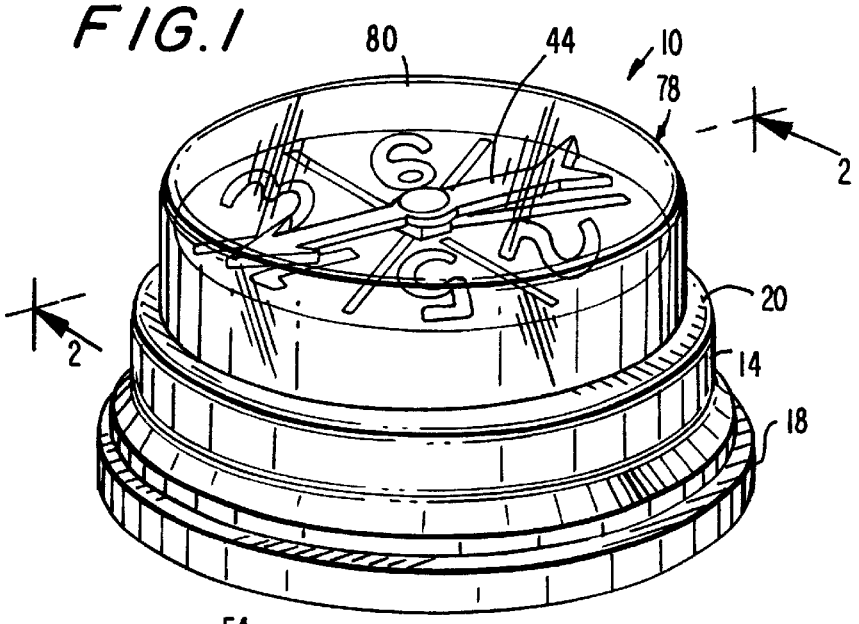
FIG. 7
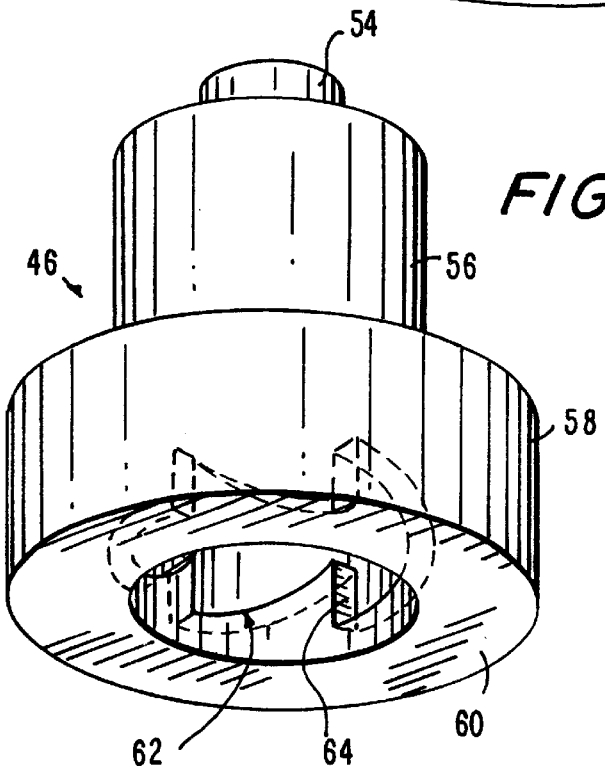
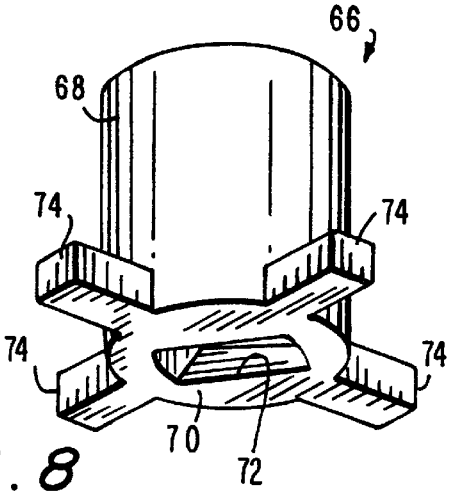
FIG. 8

10
34
78
38
82
20
84
40
18
14
16
36
80
A
44
48
56
A
42
76
12
30
64
3
46
58
28
22
24
26
70
52
68
66
74
32
62
B

GAME SPINNER

BACKGROUND OF THE INVENTION

1. Field of the Invention

The present invention generally relates to a game device and, more particularly, to a spinner operative for selecting, by chance, indicia that indicates the next move in a game, especially a board game.

2. Description of the Related Art

Board games are well known in the art. A conventional board game typically includes a game board having a plurality of playing spaces or stations defining a path of travel; a plurality of playing pieces, one for each player of the game; and a chance device for determining the number of playing stations a particular playing piece is to advance along the travel path, or for broadly indicating to the player what the next move is. The chance device contributes to overall game play by introducing an unknown, unpredictable element of luck.

As exemplified by U.S. Pat. Nos. 3,441,281; 3,442,512; 3,810,628; 3,861,686; 5,332,227; and 5,382,023, a conventional chance device includes a spinner that is spun and that selects an indicium when the spinner comes to a rest. Typically, a player rotates an arrow over a dial subdivided into different regions bearing markings. The arrow points to one of the markings when the arrow stops rotating. Such rotatable spinners are very popular, but are disadvantageous in that a player may seek to compromise the element of luck somewhat by controlling the force and extent by which the player rotates the arrow.

Another popular chance device is a stack of preprinted cards bearing messages for the players, each card to be selected and obeyed by a player in a respective turn. Here again, a player may seek to compromise the luck element of the game by not mixing the cards sufficiently to sort the cards in a random order.

Still another chance device utilizes a die marked on each of its six sides with from one to six dots. The die is mounted within a container which, when pushed downwardly against a spring, causes the die to flip over with a quick motion to expose an upper side with the number of dots to be used in playing the game.

SUMMARY OF THE INVENTION

OBJECTS OF THE INVENTION

Accordingly, it is a general object of this invention to improve game play by insuring that game moves are selected randomly.

More particularly, it is an object of the present invention to provide a random chance selector that is inexpensive in manufacture, durable in construction, and easy to use.

FEATURES OF THE INVENTION

In keeping with the above objects and others which will become apparent hereafter, one feature of the present invention resides, briefly stated, in a game spinner having a base and an upright threaded rod fixed to, and extending along an axis away from, the base. A dial housing is mounted on the base and has a dial subdivided into a plurality of chance regions, for example, numerals or other indicia.

The spinner further comprises a rotor which includes an indicator overlying the dial, and a casing underneath the dial and connected to the indicator through the dial for joint spinning with the indicator about the axis. In the preferred embodiment, the casing has a circular track concentric with the axis, and a plurality of stops on the track.

An engageable clutch preferably includes a sleeve having a hub with an opening for threadedly engaging the threaded rod, and a plurality of radial arms freely ridable on and along the track in one circumferential direction. In the opposite circumferential direction, as described below, the arms are engaged by the stops.

A compressible spring is mounted between the dial and the base. A push member is mounted on the base for axial movement between a pressed position in which the spring is compressed to store energy in the spring, and a released position in which the energy stored in the spring is suddenly released.

During manual movement of the push member to the pressed position, the dial, the rotor and the clutch are moved in one axial direction, e.g., downwardly toward the base. The threaded rod enters and is threaded through the hub opening during this downward movement. The arms freely ride along the track without mechanical interference.

During movement of the push member to the released position, the dial, the rotor and the clutch are suddenly moved by the spring in the opposite axial direction, e.g., upwardly away from the base. The threaded rod is unthreaded through the hub opening and rotates the arms into engagement with the stops to turn the sleeve jointly with the rotor. A sudden release of the spring causes the rotor to rapidly spin for a time until the indicator eventually comes to a halt in one of the chance regions of the dial.

In accordance with this invention, game moves are randomly selected. No longer does a player directly control the extent of rotating an indicator since it is a released spring that spins the indicator. Overall game play is enhanced.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is a perspective view of a game spinner in accordance with this invention;

FIG. 7 is a bottom perspective view of one of the components of the game spinner; and FIG. 8 is a bottom perspective view of another of the components of the game spinner.

DETAILED DESCRIPTION OF THE PREFERRED EMBODIMENTS

Figures 2, 3, 4, 5:
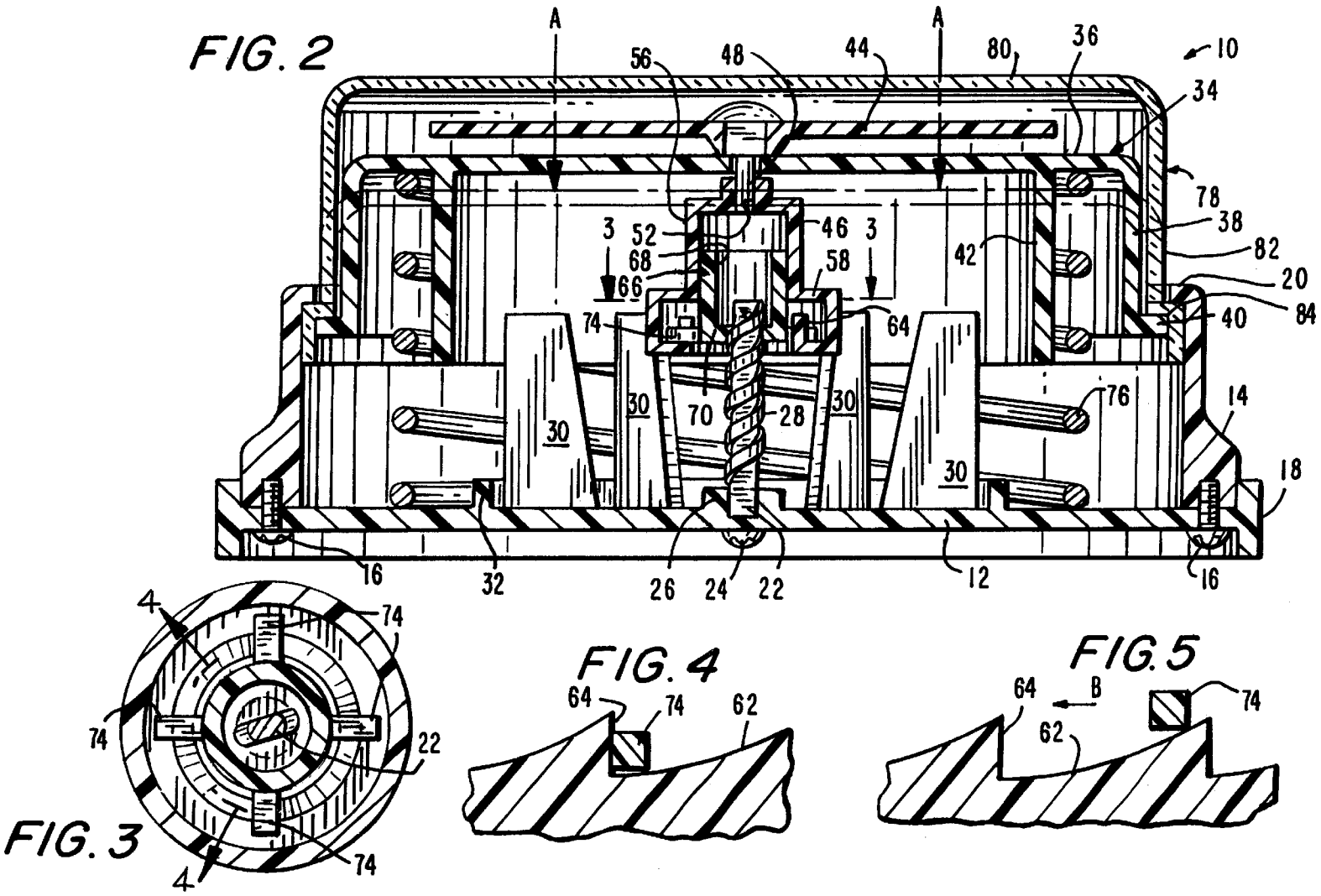
FIG. 2 is an enlarged sectional view taken on line 2—2 of FIG. 1.
FIG. 3 is a further enlarged sectional view taken on line 3—3 of FIG. 2.
FIG. 4 is a still further enlarged sectional view taken on line 4—4 of FIG. 3 in one operating condition.
FIG. 5 is a view analogous to FIG. 4, but in another operative condition.

Referring now to the drawings, reference numeral 10 generally identifies a game spinner having a base which includes a bottom circular plate 12 (see FIG. 2) and a hollow cylindrical receptacle 14 fixed to the plate 12 by a set of screws 16. A circular footing 18 surrounds the outer periphery of the plate and elevates the plate above a support surface, such as a game board or a tabletop. The receptacle 14 has an upper circular flange 20 extending in a radial direction, as explained in further detail below. The receptacle 14 is seated within, and bounded by, the footing 18.

An upright threaded rod 22 is fixed to, and extends upwardly along a vertical axis away from, the plate 12. As shown in FIG. 2, a screw 24 extends through the center of the plate 12 and through a center boss 26 into a lower end of the rod 22. The rod 22 has a generally rectangular core (see FIG. 3) and a helical thread 28 that is spirally wound around the core.

A plurality of radial fins 30 equi-angularly spaced around the axis is integral with the plate 12, preferably by being simultaneously molded of a synthetic plastic material. A raised circular ridge 32 bounds a shallow compartment in which the fins are accommodated.

A dial housing 34 is mounted within the receptacle 14. The dial housing has a generally planar, upper circular wall 36 subdivided into a plurality of sector-shaped chance regions numbered with numerals one through six. The chance regions need not be sector-shaped, nor need they bear numerals since any indicia or marking could be employed in game play. The dial housing also has a cylindrical side wall 38 extending downwardly from the upper wall 36, and terminating in a circular lip 40 extending in the radial direction, as explained in further detail below. The housing 34 still further includes, as shown in FIG. 2, a guide tube 42 extending downwardly, and integral with, the dial 36.

Figure 6:
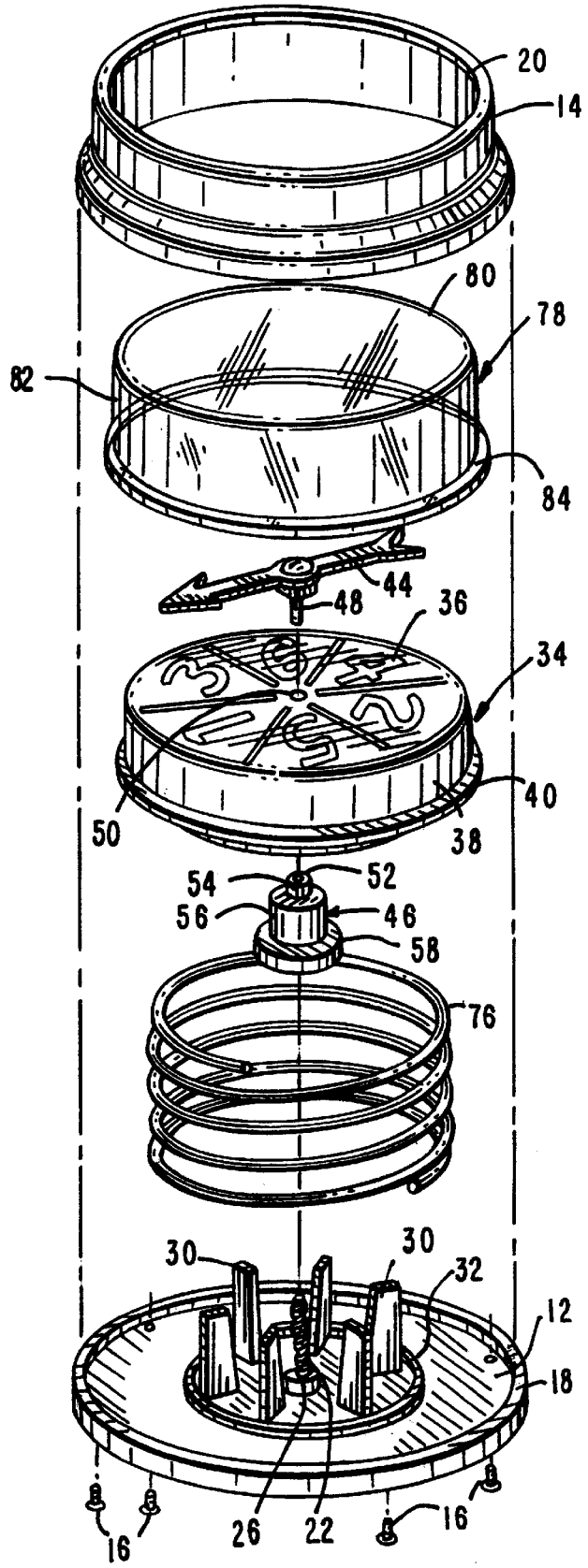
FIG. 6 is an exploded, perspective view of the game spinner of FIG. 1.

The spinner includes a rotor comprised of an indicator 44 juxtaposed with the dial 36, and a casing 46 connected to the indicator for joint spinning therewith about the axis. As shown in FIG. 6, the indicator 44 is shaped as an arrow with an arrowhead pointing to one of the chance regions on the dial 36. The indicator is mounted above the dial and has a shaft 48 that extends through a hole 50 in the dial and is press-fitted into an upper opening 52 in the casing 46 which is located underneath the dial.

The casing 46 is shown in isolation in FIG. 7 and includes an upper section 54 which bounds the opening 52, an intermediate cylindrical section 56 having a predetermined diameter, and a lower cylindrical section 58 of greater diameter and having a base wall 60 lying in a plane. A circular track 62 concentric with the axis is provided on the base wall 60 within the lower cylindrical section 58. The track includes a plurality (as shown, four) of track sections, each rising in elevation relative to the plane of the base wall 60 and terminating in a stop 64. The operation of the stops and the track sections is described in detail below in connection with FIGS. 4 and 5.

The spinner includes a clutch having a sleeve 66 mounted within the casing 46 in FIG. 2, and shown in isolation in FIG. 8. The sleeve 66 has an upper cylindrical portion 68 slidably mounted within the intermediate section 56 of the casing 46, and a lower hub portion 70 having a generally rectangular opening 72, and a plurality (as shown, four) of radial arms 74 ridable on and along the track 62. The opening 72 has a complementary contour to the rectangular core of the threaded rod 22. The arms 74 are equidistantly spaced apart, one arm for each track section, as explained below.

A compressible coil spring 76 having opposite open ends is mounted between the dial 36 and the plate 12. The guide tube 42 is inserted into the upper end of the spring. The fins 30 and the ridge 32 are inserted into the lower end of the spring.

A push member 78 is mounted on the receptacle 14 for axial movement, and includes a generally planar, circular top wall 80, a cylindrical side wall 82 extending downwardly away from the top wall 80, and a circular abutment 84 extending in the radial direction. The push member 78 is constituted of a light-transmissive material to enable viewing therethrough.

As shown in the assembled condition of FIG. 2, the spring 76 is under tension and constantly urges the dial housing 34 upwardly away from the plate 12 until the lip 40 engages the abutment 84 and, in turn, constantly urges the push member 78 upwardly away from the plate 12 until the abutment 84 engages the flange 20 of the receptacle. The upper threaded end of the rod 22 has entered the casing 46 and is threaded through the opening 72 in the sleeve 66.

To actuate the spinner 10, a player must depress the push member 78 by pressing downwardly to a desired extent in the direction of the arrows A on the top wall 80. Pushing down on the push member 78 causes the abutment 84 to push on the lip 40 to simultaneously move the dial housing 34 down. This causes the spring 76 to be compressed to the desired extent. The indicator 44, the casing 46 and the sleeve 66 likewise participate in this downward axial movement. The downwardly moving sleeve 66 turns in one circumferential direction about the axis as the sleeve is threaded onto the threaded rod 22. The arms 74 of the sleeve 66 freely ride on and along the track 62 without mechanical interference from the stops 64. Each arm 74 slides on a respective track section and rises in elevation relative to the base wall 60. At its highest elevation, each arm 74 passes over a respective stop 64 and falls to the lowest elevation of the next track section. This alternating rising and falling is repeated during the downward movement of the sleeve 66. This represents a disengaged position for the clutch since no rotary force is transmitted from the sleeve 66 to the casing 46. This also represents a compressed condition for the spring and a pressed position for the spinner.

As previously stated, the spring is compressed, thereby storing potential energy therein. When the player lets go of the top wall 80, the stored energy of the spring is suddenly released. The expanding spring pushes the dial housing 34 upwardly and, via the engagement between the lip 40 and the abutment 84, pushes the push member 78 upwardly until the abutment 84 again contacts the flange 20 on the receptacle. The indicator 44, the casing 46 and the sleeve 66 participate in this upward axial movement. The upwardly moving sleeve 66 rotates in an opposite circumferential direction about the axis as the threaded rod 22 withdraws from the sleeve 66. The arms 74 of the sleeve 66 ride on the track 62 until they meet the stops 64 which, this time, blocks their way.

As shown in FIG. 5, a respective arm 74 is riding along a track section toward the left in the direction of arrow B from a highest elevation to a lowest elevation until the respective arm 74 abuts against the stop 64. The arm 74 cannot pass over the stop 64 and hence carries the stop in its path. This causes the casing 46 to spin and, at the same time, the indicator 44 spins because the indicator is fixed to the casing. The sudden release of the spring causes a rapid spinning of the indicator. This represents an engaged position for the clutch since rotary force is transmitted between the sleeve 66 and the casing. This also represents a released position for the spinner.

The indicator 44 eventually stops spinning once the released energy is spent, and frictional forces brake the indicator. The pointing of the indicator to one of the chance regions on the dial represents the next randomly generated game move.

It will be understood that each of the elements described above, or two or more together, also may find a useful application in other types of constructions differing from the types described above.

While the invention has been illustrated and described as embodied in a game spinner, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

We claim:

1. A game spinner, comprising:

a) a base;

b) an upright threaded rod fixed to, and extending along an axis away from, the base;

c) a dial having a plurality of chance regions;

d) a rotor, including an indicator juxtaposed with the dial, and a casing connected to the indicator for joint spnning therewith about the axis;

e) an engageable clutch operatively connected, when engaged, in a force-transmitting relationship between the casing and the threaded rod;

f) a compressible spring between the dial and the base; and g) a push member mounted on the base for axial movement between a pressed position in which the dial is moved in one axial direction to compress and store energy in the spring, and a released position in which the energy stored in the spring moves the dial and the casing in an opposite axial direction to engage the clutch and spin the rotor until the indicator halts in one of the chance regions on the dial.

2. The spinner of claim 1, wherein the base includes a bottom plate, and a hollow receptacle fixed to the bottom plate and having an upper radial flange.

3. The spinner of claim 2, wherein the push member has a top wall, a side wall extending away from the top wall and mounted for sliding movement relative to the receptacle, and a radial abutment for engaging the flange in the released position.

4. The spinner of claim 3, wherein the dial is an upper wall of a dial housing having a side wall and a radial lip that engages the abutment in the released position.

5. The spinner of claim 4, wherein the spring is a coil spring having opposite open ends, and wherein the dial housing has a guide tube inserted into one of the open ends of the coil spring.

6. The spinner of claim 5, wherein the base includes a plurality of fins inserted into the other of the open ends of the coil spring.

7. The spinner of claim 2, wherein the base includes a circular footing on the bottom plate for supporting the bottom plate above a support surface.

8. The spinner of claim 1, wherein the dial is circular, wherein the chance regions are sectors on the dial, each sector bearing an indicium; and wherein the indicator has an arrowhead for pointing to said one of the chance regions.

9. The spinner of claim 1, wherein the push member is constituted of a light-transmissive material to enable viewing of the indicator and the dial.

10. The spinner of claim 1, wherein the casing has a circular track concentric with the axis, and a plurality of stops on the track; and wherein the clutch includes a sleeve mounted within the casing and having a plurality of radial arms riding on the track, and wherein the arms engage the stops in the released position.

11. The spinner of claim 10, wherein the sleeve has a hub with an opening that threadedly engages the threaded rod.

12. The spinner of claim 11, wherein the rod has a generally rectangular core and has a helical thread spirally wound around the core; and wherein the opening of the hub is generally rectangular to receive the core.

13. The spinner of claim 10, wherein the casing has a base wall lying in a plane, and wherein the track includes a plurality of track sections each rising in elevation relative to said plane until terminating in a respective one of the stops.

14. A game spinner, comprising:

a) a base;

b) an upright threaded rod fixed to, and extending along an axis away from, the base;

c) a dial housing having a dial subdivided into a plurality of chance regions;

d) a rotor, including an indicator overlying the dial, and a casing underneath the dial and connected to the indicator through the dial for joint spinning with the indicator about the axis, said casing having a circular track concentric with the axis, and a plurality of stops on the track;

e) an engageable clutch, including a sleeve having a hub with an opening for threadedly engaging the threaded rod, and a plurality of radial arms freely ridable on and along the track in one circumferential direction, and being engaged by the stops in an opposite circumferential direction;

f) a compressible spring between the dial and the base; and g) a push member mounted on the base for axial movement between a pressed position in which the dial, the rotor and the clutch are moved in one axial direction to compress and store energy in the spring while concomitantly threading the threaded rod through the hub opening, and a released position in which the energy stored in the spring moves the dial, the rotor and the clutch in an opposite axial direction while concomitantly unthreading the threaded rod through the hub opening and turning the arms into engagement with the stops to spin the casing and the indicator for a time until the indicator halts in one of the chance regions of the dial.

15. The spinner of claim 14, wherein the base includes a receptacle with an upper radial flange, wherein the push member includes a radial abutment engaging the flange in the released position, and wherein the dial housing has a radial lip engaging the abutment in the released position.

16. The spinner of claim 14, wherein the spring is a coil spring having opposite open ends, and wherein the dial housing has a guide tube inserted into one of the open ends of the spring, and wherein the base has a plurality of fins arranged in an annulus and inserted into the other of the open ends of the spring.

17. The spinner of claim 14, wherein the push member is transparent to enable viewing of the indicator and the dial.

* * * * *